United States Patent [19]

Gardellini

[11] Patent Number: 4,884,671

[45] Date of Patent: Dec. 5, 1989

[54] PAPER CURRENCY ACCEPTOR AND METHOD OF HANDLING PAPER CURRENCY FOR VENDING MACHINES AND THE LIKE

[76] Inventor: Vedasto Gardellini, 23 Sheldon Pl., Commack, N.Y. 11725

[21] Appl. No.: 273,176

[22] Filed: Nov. 14, 1988

Related U.S. Application Data

[63] Continuation of Ser. No. 812,365, Dec. 23, 1985, abandoned.

[51] Int. Cl.[4] ..... B07C 5/00

[52] U.S. Cl. ..... 194/207; 209/534; 194/210

[58] Field of Search ..... 194/206, 207, 210; 209/534

[56] References Cited

U.S. PATENT DOCUMENTS

| | | | |
|---|---|---|---|
| 3,765,523 | 10/1973 | Nakanishi | 209/534 X |
| 3,783,989 | 1/1974 | Jensen | 194/206 |
| 4,011,931 | 3/1977 | Wyckoff | 209/534 X |
| 4,348,656 | 9/1982 | Gorgone et al. | 194/213 X |
| 4,349,111 | 9/1982 | Shah et al. | 194/206 X |
| 4,418,824 | 12/1983 | Gorgone et al. | 209/534 |
| 4,447,714 | 5/1984 | Lundblad | 194/206 X |
| 4,470,496 | 9/1984 | Steiner | 194/206 X |
| 4,513,439 | 4/1985 | Gorgone et al. | 194/206 X |
| 4,540,081 | 9/1985 | Mori et al. | 194/207 |
| 4,556,139 | 12/1985 | Akagawa et al. | 209/534 X |
| 4,678,072 | 7/1987 | Kobayashi et al. | 194/206 |

FOREIGN PATENT DOCUMENTS 2453811 11/1980 France .

*Primary Examiner*—Joseph J. Rolla
*Assistant Examiner*—Mona C. Beegle
*Attorney, Agent, or Firm*—Bauer & Schaffer

[57] ABSTRACT

A paper currency acceptor having general utility and more specifically for use as a retrofit for a coin vending machine having coin mechanism in which there is very limited space for the paper currency acceptor. The acceptor includes longitudinally directed coextensive verification and receiving stations through which successive sheets of paper currency are moved with their planar surfaces substantially vertical from an inlet to a storage position where the sheets are stacked in their vertical positions thereby enabling the acceptor to be mounted horizontally in the limited space of the machine for cooperation with the machine's coin mechanism.

7 Claims, 5 Drawing Sheets

FIG. 1
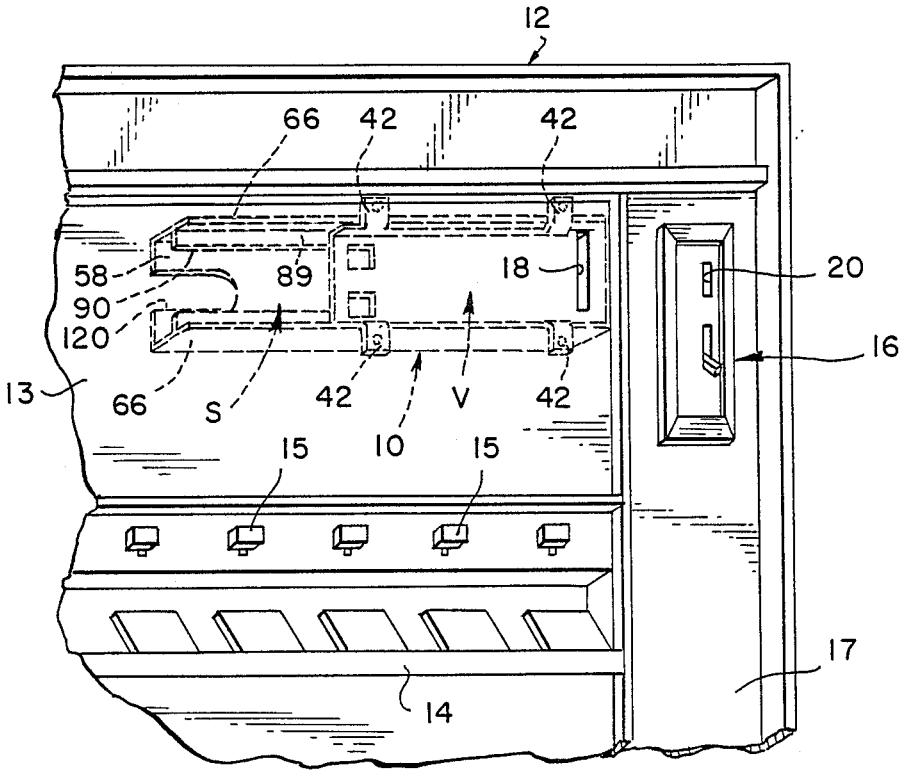
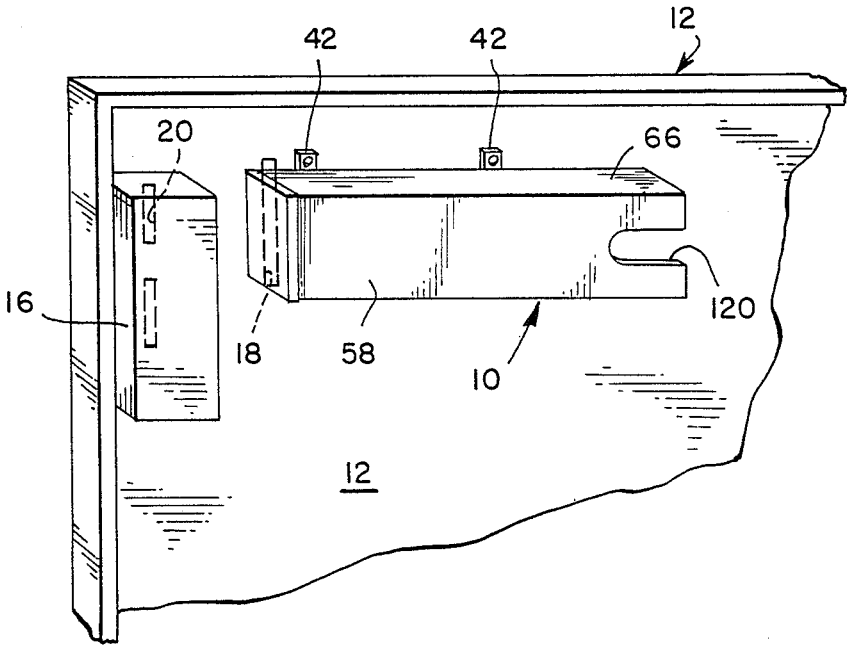
FIG. 2

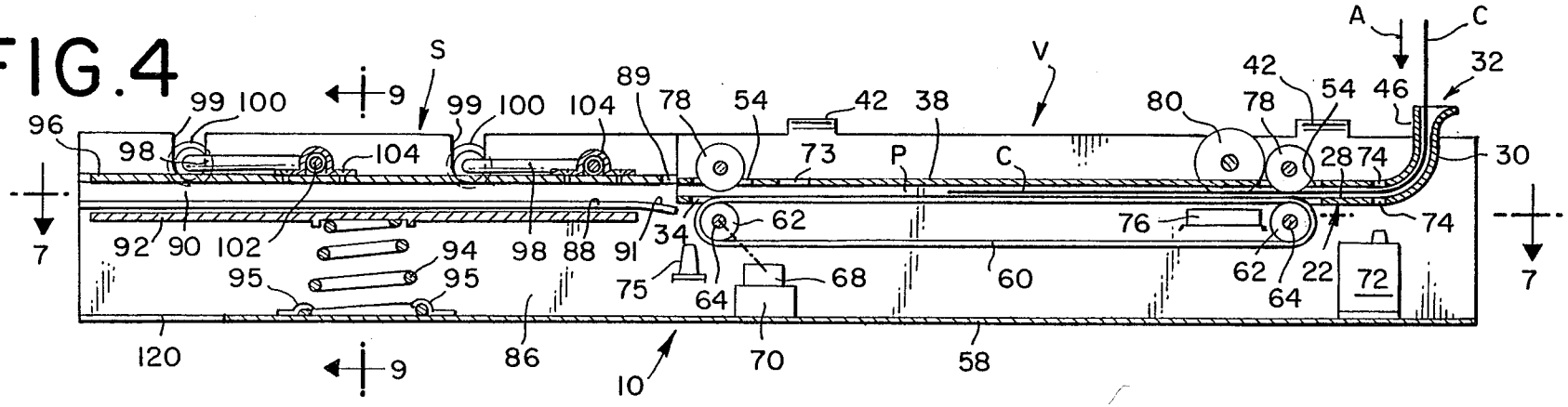
FIG. 4
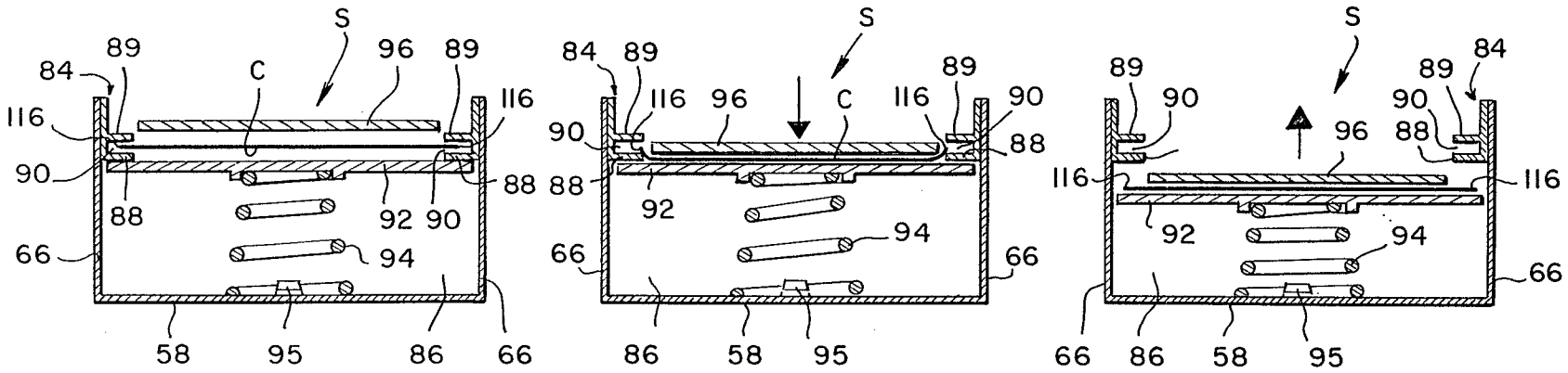
FIG. 9
FIG. 10
FIG. 11

PAPER CURRENCY ACCEPTOR AND METHOD OF HANDLING PAPER CURRENCY FOR VENDING MACHINES AND THE LIKE

This is a continuation of Ser. No.: 812,365 Filed: Dec. 23, 1985, now abandoned.

BACKGROUND OF THE INVENTION

The present invention relates to a paper currency acceptor and method of handling paper currency in vending machines.

Vending machines are generally operable by mechanisms rendered effective by the introduction of a predetermined number and combination of coins to cause the machine to dispense products of like value therefrom. The present invention is especially adapted for retrofitting vending machines with the present invention to enable conventionally operated coin machines to accept paper currency in addition to and/or in lieu of coins.

The cost of many products particularly cigarettes has increased such that it is no longer convenient and/or practicable to insist that they be vended in coin-only operated machines. Until now, however, separate paper currency changers have been installed adjacent to or alongside of coin-only operated machines to provide a sufficient supply of coins. Such paper currency changers, however, are relatively expensive and are practicable only when a substantial number of coin operated vending machines are in the same location. On the other hand, most coin operated vending machines are individually placed or placed with only a limited number of companions, whereby provision of a paper currency changer would be uneconomical, as well as inconvenient.

It is the object of the present invention to provide a paper currency acceptor that is relatively simple in construction and inexpensive to manufacture and which can be mounted, as a retrofit device to existing coin-only operated machines in a location thereon that does not require reconstruction of the door details of the machine and that can be located conveniently adjacent the already existing coin mechanism.

It is a further object to provide a paper currency acceptor which is directly connected to the coin mechanism so that the customer need not go through the added step of first changing the paper currency into coin before operating the vending machine.

It is further object to provide a paper currency acceptor which is mounted within the vending machine, thereby increasing security and preventing common thefts and the like.

These foregoing objects, together with other objects and advantages, will be apparent from the following disclosure.

SUMMARY OF THE INVENTION

According to the present invention, a paper currency acceptor is provided for vending machines. The paper currency acceptor comprises means for conveying stepwise individual successive sheets of paper currency or bills in line in a path from a receiving inlet slot, through a verification station and into a storage station. The verification station includes means for sensing the value and authenticity of the currency and converting their value into a signal indicative of its value in coins and so signalling the coin mechanism to provide change therefor, and to selectively cause a conveying means to move the paper currency to the storage station or to reject and return the paper currency to the customer at the receiving slot. The storage station includes means to receive individual sheets of currency and to stack successive ones of them, one on top of the other.

In the preferred form of the invention, the verification and storage stations are aligned longitudinally and coextensive to that a continuous straight in-line path is provided for the movement of the sheets of currency. Movement or transport of the paper currency is provided by a single positive conveyor system comprising a continuous belt conveyor operated at the verification station. The belt conveyor is sufficiently long to receive the paper currency from the inlet slot and to push and move the same completely into alignment with the storage station.

In the preferred form of the invention, the sheets of paper currency are stacked one upon the other at the storage station by displaying the paper currency from their path of movement in a direction perpendicular to the direction of movement while maintaining the sheets of currency parallel to each other. The sheets of paper currency are displaced against a resiliently yieldable support or platform. As a result, a relatively large stack of currency can be stored in a relatively small space.

Full details of the invention are set forth in the following disclosure, and illustrated in the accompanying drawings.

BRIEF DESCRIPTION OF THE DRAWING

IN THE DRAWINGS

Figure 3:
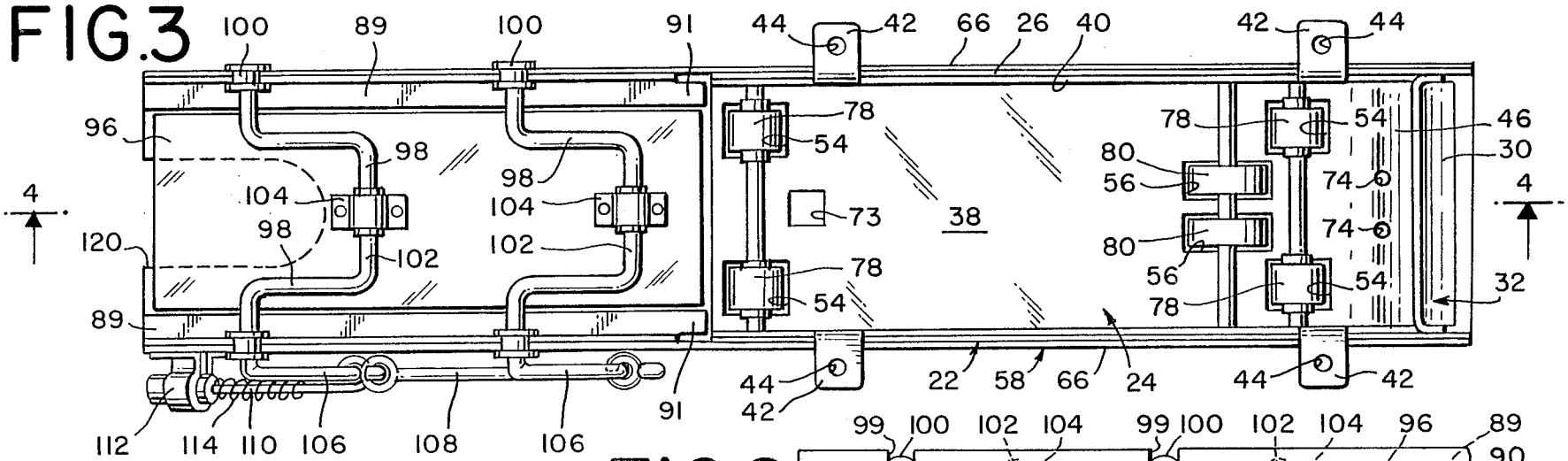
Figure 8:
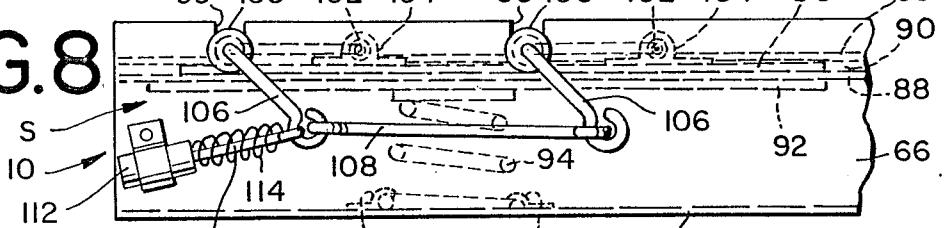
Figure 7:
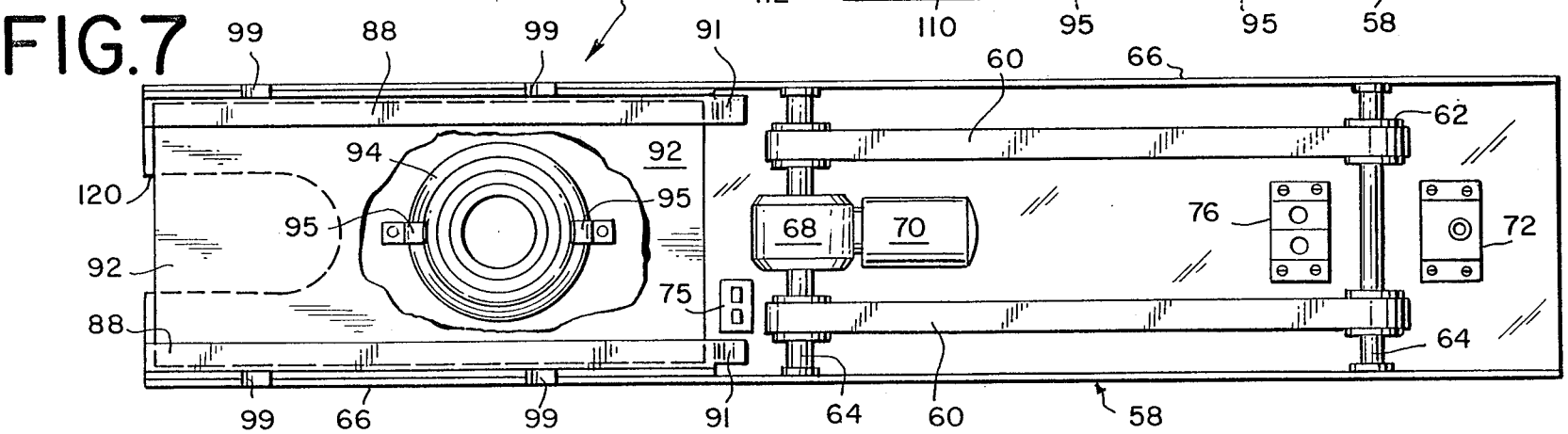
Figures 5, 6, 12:
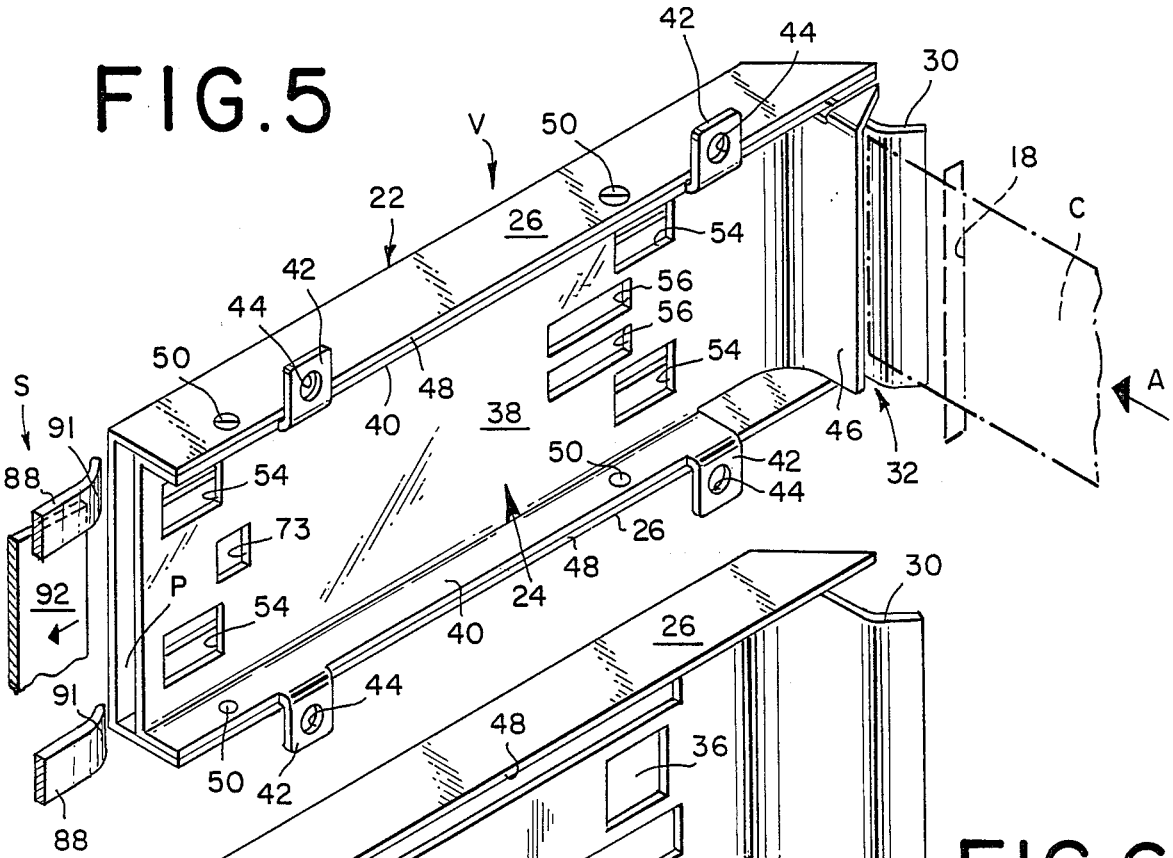
Figure 13:
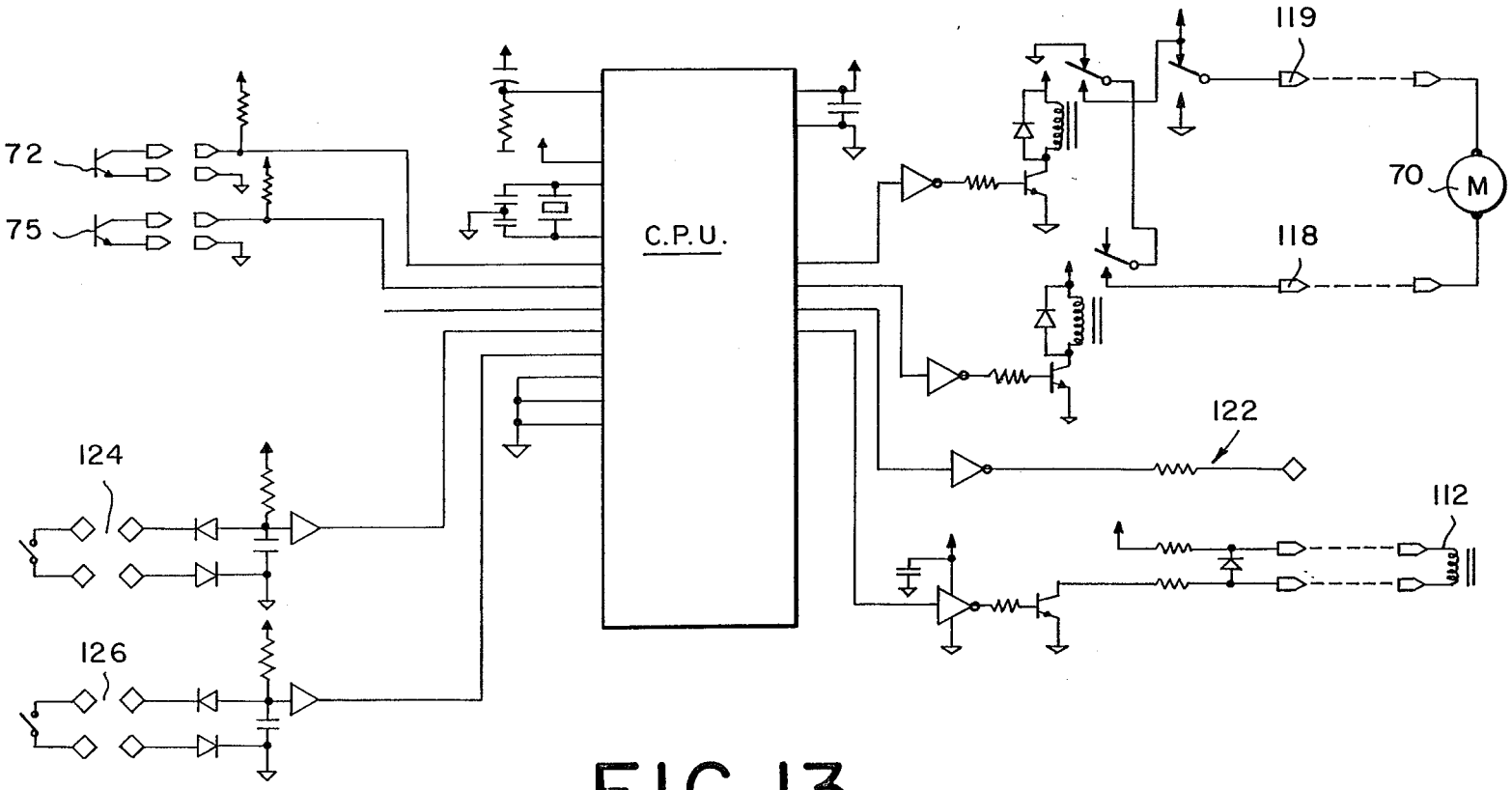

FIG. 1 is a partial front perspective view of the door of a conventional coin operated vending machine having a portion thereof dedicated to advertising the products of the machine and diagrammatically illustrating the present paper currency acceptor in broken lines mounted to the rear thereof according to the teaching of the present invention;

FIG. 2 is a partial perspective view of the rear of the front door shown in FIG. 1 showing the paper currency acceptor of the present invention mounted thereon;

FIG. 3 is a top plan view of the paper currency acceptor showing the alignment of the verification and storage status;

FIG. 4 is a cross-sectional view of the paper currency acceptor of the present invention taken substantially along lines 4—4 of FIG. 3 showing the details of the verification and storage stations;

FIG. 5 is a perspective view of the body housings and panels of the verification station in its orientation as mounted in FIG. 1;

FIG. 6 is a separate perspective view of one of the troughs of the verification station shown in FIG. 5;

FIG. 7 is a cross-section of FIG. 4 broken along lines 7—7 with portions partially sectioned to show the interior of the storage station;

FIG. 8 is a longitudinal side view of the storage station of FIG. 3;

FIGS. 9, 10, and 11 are sequential cross-sectional views taken along lines 9—9 of FIG. 4 showing the sequential operation of the storage hopper;

FIG. 12 is a schematic showing of the operation of the present invention; and FIG. 13 is a circuit diagram of the central program control unit of the present invention.

DESCRIPTION OF THE INVENTION

The composite paper currency acceptor of the present invention as generally designated by the numeral 10 in FIGS. 1 and 2, is illustrated for use on and with a conventional coin operated vending machine. It has been applied to the machine as a retrofit package so that modification or change of the vending machine, beyond the means for securing the system thereto, is not required. Although the acceptor 10 is so shown and described hereinafter, it will become apparent to those skilled in the art that it is not intended to be limited thereto but has broader application and scope of use.

Common in conventional vending machines is the provision of a substantially vertical front door 12 that is generally constructed of metal to foil pilferage. The door 12 usually has a front panel or portion 13 that is dedicated to the illustration and advertising of the products dispensed by the machine at the vending opening 14 by the operation of the selection knobs or buttons 15. The panel portion 13 is very costly and is usually backed by a metal wall of the door so as to prevent access to the interior of the machine even if the panel is broken. The coin mechanism 16 is located in panel 17 outside the area of the panel 13 and on a rigid margin or border of the door.

Because coin mechanisms 16 are limited in the amounts they can count and are no longer convenient for use in vending machines, it has become necessary to add paper currency acceptors to such machines to operate in conjunction with the coin mechanisms to provide change in coins when the customer does not have the correct amount of change and must use paper money in excess of the cost of the product to be purchased. The addition of paper currency acceptors 10 to new machines is not a problem; however, machines presently in use are still usable and costly to scrap. Hence, they must be capable of being retrofit with paper money acceptors that do not interfere with the machine operation and without damage to or defacement of the important and expensive advertisement portion or panel 13.

Moreover, the addition of a paper currency acceptor to such used machines must be accommodated within the limited space behind the door 12 without interfering with either the machine operation or reducing the amount of products it can inventory and vend. The present paper currency acceptor 10 accomplishes all of the above by being able to be mounted to the interior of the machine, preferably to the rear of the door and in a horizontal position behind the portion 13, and in such manner that the paper currency is moved and stored with its surfaces in a plane substantially vertical and substantially parallel to the door. This arrangement and mounting requires little room and fits within the area of the machine that is free of interference with the machine operation and its inventory of products.

Since the paper currency acceptor 10 of the present invention is able to be mounted at the rear of the door 12, a receiving slot 18 is provided in the door advertising panel portion 13 adjacent to the coin receiving slot 20 of the coin mechanism 16. The two slots 18 and 20 are located adjacent to each. In new machines they may be on the panel 17. When used as a retrofit for used machines, the slot 20 is unobtrusively and conveniently provided in the portion 13 free of interference with or obstruction of the illustration on the panel thereby avoiding the expensive replacement of the same. Consequently, the machine is able to be used in the same but enhanced manner than before it is retrofit with the present paper currency acceptor 10.

As seen in the figures of the drawings, the paper currency acceptor 10 comprises a verification station V and a storage station S. The verification station V comprises a device in which paper currency, i.e., an individual sheet of paper currency C is temporarily received, verified as to its authenticity and value and from which the paper currency, if acceptable, is transferred in the direction of the arrow A (Figs. 4 and 5) to the storage station S or, if not acceptable is returned to the consumer as a reject, through the slot 18. The storage station S comprises a device by which the sheets of paper money are sequentially received and stacked one upon the other first in a stack and retained so bundled.

The verification device V comprises passageway P for the paper currency defined by a pair of troughs generally identified 22 and 24 telescoped together with the member 24 received within the member 22 in top to bottom engagement. The bottom outer trough 22 is of generally U-shaped cross-section, having a pair of side walls 26 and a bottom wall 28. The inner trough 22 is open at its left or downstream end. The upstream end 30 of the bottom wall 28 is elongated and smoothly curved upwardly between the side walls 26 to define one side of a flat funnel-like entrance generally identified 32 aligned and coextensive with and positioned behind the inlet slot 18 in the portion 13. The bottom wall 28 of the bottom trough 22 is provided with a pair of elongated rectangular cut-outs 34 spaced from each other and respectively extending lengthwise adjacent to and parallel to the side walls 26. Located between the upstream ends of the elongated cut-outs 34 is a singular square cut-out 36.

The top inner trough 24 is also substantially U-shaped in cross-section having a flat bottom wall 38 and a pair of side walls 40 from each of which extends a pair of perpendicular tabs 42 each having a hole 44 through which the mounting fastening means as screws or bolts 45 pass (FIG. 1). The rear end 46 of the top inner trough 24 is smoothly curved to form a right angle turned generally parallel to the upstream end 30 of the outer trough 22 to provide the second mating wall of a passageway entrance or funnel 32. The outside transverse dimension of the top trough 24 and the corresponding inside dimension of the bottom trough 22 are roughly the same so as to permit a tight-fit frictional engagement of the top trough 24 within the bottom trough 22.

The side walls 40 of the top trough 24 are of such a depth that when the top trough 24 is placed into the bottom trough 22, the tabs 42 engage and abut the edges 48 of the side walls 24 of the bottom outer trough 22 providing a limit stop for their relative telescoping engagement. This stop ensures the proper formation and retention of a passageway P that defines a narrow continuous flat space extending the length of the station V through which the sheet of paper currency freely moves and is guided. The side walls 26 of the bottom outer trough 22 are connected to the side walls 40 of the top inner trough 24 by one or more screws 50 so that the two troughs are securely held together and prevent the guide passageway P from changing its form and size.

The bottom wall 38 of the top inner trough 24 is formed with a small rectangular opening 54 located in alignment respectively at each of the up and downstream ends of each of the elongated cut-outs 34 formed in the bottom outer wall 28 of the bottom outer trough 22. A pair of narrow rectangular elongated openings 56 are furthermore arranged in the bottom wall 38 in alignment with the square cut-out 36 in the bottom wall 28 of the inner trough 22.

The assembled troughs 22 and 24 are covered by and housed within a longer length housing 58 also having a conforming substantially U-shaped cross-section. As will become clear, the housing 58 is of greater depth than the troughs of the verification station V resulting from its longer side walls 66. Located within the deeper housing 58 are a pair of roughened or high-friction endless conveyor belts 60 the upper runs of which extend into the elongated cut-outs 34 in the bottom wall 28 of the bottom outer trough 22 and thus into the passageway 50 to engage and move the paper currency C from between the inlet 18 and the storage station S. The belts 60 are respectively entrained over a pair of longitudinally spaced rollers 62. The corresponding rollers 62 for each of the belts 60 at the upstream and downstream ends are fixed on a common shaft 64 which shafts are freely journalled in the side wall 66 of the housing 58.

The upstream shaft 64 is driven via a conventional drive transmission 68 by a small reversible electric motor 70, fixedly mounted in the housing 58. The electric motor 70 is capable of driving the conveyor belts in both the upstream and downstream directions dependent upon the polarity of the current provided to it. Mounted also in the housing 58 in line with the inlet funnel 32 is a pair of laterally spaced photocells 72 to immediately sense the presence of a paper currency at the inlet funnel 30 and to provide a conveyor belt driving signal in response thereto.

The bottom wall and the bottom walls 28 and 38 of the bottom and top troughs 22 and 24 respectively are provided with light passage holes 74 aligned with the photocells 72 for the introduction or interdiction of light to the photocells 72. One of such light passage holes 74 is provided for each such photocell 72. In practice two photocells 72 are provided in lateral spaced relation. Hence, two light passage holes 74 are shown in FIG. 3. Mounted also in the housing downstream of the belts 60, is a sensing device 75, such as a microswitch, or photocell which detects the presence of the leading edge of the paper currency C when the same reaches the sensing aligned openings 73 in the walls 28 and 38. The relative lengthwise space of the sensor 75 with respect to the initial sensors 22 is equal to the average length of paper currency to be used in the passageway. If the currency C is too short, it will not simultaneously trigger both sensors. Hence, it will be rejected.

Mounted within the housing 58 beneath and to extend through the square cut-out 36 in the bottom wall 28 of the bottom outer trough 22 is a pair of magnetic sensing devices 76 which sense critical indicia found on the paper currency. It is known, for example, that U.S. paper currency contains a magnetic indicia in its body indicating its value and its authenticity. The devices 76 are well known as the sensing means for detecting the indicia to verify the authenticity of the paper money.

Mounted on the top inner trough 24, in the openings 54, and aligned with the belts 60 are two sets of idler rollers 78. These rollers are spaced relatively close to the entrance 32 and near the ends of the belts 60. Similarly mounted in the top inner trough 24 in line with the magnetic sensing heads 76 is another pair of idler rollers 80 which extend through the paired openings 56. The idler rollers 78 and 80 engage with the planar surfaces of the sheets of paper currency to ensure they are pressed into moving engagement with the endless belts 60 and the magnetic heads 76. This ensures that paper currency inserted in the passageway P is positively transported in either direction and makes firm and complete contact with the magnetic sensing heads 76 and the moving belts.

The storage station S is arranged in longitudinal alignment with the verification station V and is so closely positioned at the exit end thereof such that each station is a coextensive continuation of the other. This assures that as each sheet of paper currency C leaves the verification station V after being verified as to its authenticity and value and length, it is moved smoothly by the conveyor belts 60 to a storage position in the chamber 86 of the storage station.

The storage station S is generally U-shaped in cross-section as seen in FIGS. 9, 10, and 11 of the drawings and is preferably an abutting continuation of the verification station V. The station S is open at both its ends and is formed in part by the base wall and side walls 66 of the housing 58. Its lateral extent is defined between the side walls 66 of the housing 58 that forms a lengthwise hopper or storage chamber 86 having a storage position in which the sheets of paper currency C can be and are stored and stacked. The storage chamber S is formed by mounting to each of the inner sides of the walls 66 inverted F-shaped members 84 that have two relatively spaced inner and outer ledges 88 and 89, respectively. There are two such members 84 each of which is affixed, as by welding or by other securement to the inner surfaces of the side walls 66 of the housing 58. When so secured, the relatively spaced ledges 88 and 89 form guide surfaces that define a guide path 90 along which the successive sheets of paper currency C are moved and conveyed to the storage position. To provide for the guided movement of the paper currency, the ledges 88 and 89 extend inwardly in opposition from each of the side walls 66 for a distance of approximately one-quarter of an inch sufficient to define the paper currency guide path 90 therebetween at a level equal to and in alignment with passageway P defined between the plate-like members 28 and 38 to form a continuous extension thereof (FIG. 4).

The upstream ends 91 of the ledges 88 and 89 are bent slightly away from the entrance of the guide path 90 adjacent the exit end of the passageway P so that should the forward edge of the paper currency C, exiting from the conveyor belt 60, droop it will fall within the enlarged entrance formed by the ends 90 and make a smooth transition movement from the conveyor belt 60 and passageway P into the guide path 90. The surfaces of the ledges 88 and 89 are smooth, continuous, and unencumbered so as to allow the paper currency C to slide easily thereon. Preferably the guide path 90 ledges 88 and 89 are polished metal, although plastic surfaces can also be used. The location of the idler rollers 78 and of the forward end of the conveying belt 60 of the verification station ensure that paper currency is moved and carried by the conveyor 60 its full length from the conveyor belt 60 onto the ledges 88 and 89.

The storage position of the storage station S is located in the chamber 86 behind the ledges 88 and 89 and out of interference with or obstruction of the guide path 90 as will become clear. The storage station and its storage position includes a floating movable paper currency stacking support platform 92 supported by one or more lightweight compression springs 94 fixedly held to the base of the housing 58 by catches 95 and relatively spaced behind the platform so as to be resiliently biased in the operating direction toward and behind the guide path ledge 88. The platform 92 is wider than the distance or lateral space between the opposed side ledges 88 so that the operative biased movement of the platform is limited by engagement with the ledges 88 while its storage movement is defined and limited only by the compressed height of the compression springs 94 within the chamber 86. Although spiral helical compression springs are shown and are preferable since in the compressed state they become extremely flat, flat springs and rubber can be used.

Paper currency displacement means in the form of a presser plate 96 is located on the opposite side of the ledges 88. The paper currency displacement presser plate 96 is narrower than the lateral space between the opposing ledges 89 so that it can pass through and between the spaced ledges 88 and 89 and the guide path 90 into the chamber 86. The presser plate 96 is held and so positioned by a pair of cranks 98 which are journalled in positioning slots 99 (FIG. 4) that mount therein suitable bearings 100 on each of the side walls 66 of the housing 58. The cranks 98 have a central arm 102 which pass freely through a loop 104 fashioned on or fastened on the upper surface of the displacement presser plate 96.

When turning the cranks 98 about the axes of their bearings 100 so that the central arm 102 is level with the bearings 100, the presser plate 96 assumes an inoperative position spaced beyond the ledge 89 and out of the guide path 90. By turning the cranks 98 so that central arm 102 moves beyond the axes of the bearings 100 toward the guide path 90, the presser plate 96 will be displaced into its operative position to move between and beyond the lateral spaced ledges 89, through the guide path 90 and between the ledges 88 to displace paper currency C from the guide path and therebeyond the ledges 88 against the support platform 92 to depress it.

The bearings 100 are preferably arranged so that the operative surface of the presser plate 96 is normally not only in an inoperative position beyond the ledges 89 but also on a level out of obstruction of or interference with the guide path 90 to ensure that paper currency will move freely, unhampered and unrestricted therealong in essentially a single uninterrupted movement from the inlet 18 to the storage chamber position.

Referring to FIG. 8, it will be seen that each of the cranks 98 is provided with a fixed lever arm 106 extending from the central arm 102 at a rearward angle along the exterior of the side wall 66. Each of the lever arms 106 is articulatingly connected by a common rod 108 to the armature 110 of a solenoid 112. A spring 114 surrounds the armature 110 and abuts against the solenoid 112 and the common rod 108 thus biasing the armature 110 outwardly from the solenoid 112 and pushing the lever arms 106 of each of the cranks 98 counterclockwise into their normal inactive positions. This normally places the central crank arm 102 in a planar position with the axes of the bearings 100 maintaining the presser plate 96, in a rest position above the ledges 89.

Actuation of the solenoid 112, drawing the armature 110 into it, causes both the cranks 98 to become active to move clockwise forcing the displacement presser plate 96 to move between the ledges 89, through the guide path 90 into planar surface engagement with the planar surface of the sheet of paper currency C in the guide path 90 in line with the storage position. Continued movement causes the plate to displace the currency C from the guide path 90 into flat planar engagement with the platform 92.

This is more clearly illustrated in FIGS. 9, 10, and 11 wherein the displacement plate 96 is shown spaced beyond the guide path 90. When the lever arm 106 is rotated clockwise by the solenoid armature, the plate is moved between the ledges 89 in FIG. 10 and into the guide path 90 and into planar surface engagement with the sheet of currency C that is in line with the storage position. Continued rotation of the arm forces the longitudinal sides 116 of the sheet of currency C to deflect while the sheet C is displaced from the guide path and between the ledges 88. During its displacement the sheet of currency C is supported flat against the facing surface of the support platform 92.

Further displacement movement of the plate 96 forces the displaced sheet of currency C to move into the storage position in the chamber 86 as the support platform 92 depresses against its springs 94. When the plate 96 has completed its full travel, it is returned to its inactive position by the solenoid springs 114. The removal of its pressure enables the platform 92 to follow and return to its normal position. In its normal position, the platform holds the sheet of paper currency C supported adjacent the guide path with the longitudinal edges 116 engaged against the adjacent retention facing sides of the ledges This operation is repeated for each successive sheet of currency C that is moved in the guide path 90 to the storage station. Each such successive sheet C is stacked upon the other in the platform 92 in the storage position. The stack is compressed and retained bundled against the platform 92 by the retentive engagement between the topmost sheet of paper currency along its longitudinal edges 116 with the retention means defined by the adjacent engaged surfaces of the laterally spaced ledges 88. When so retained, the stack of paper currency is restricted from movement into obstructing relationship with the guide path 90 and the further movement of currency C therein into the storage position.

Although 112 has been described as a solenoid, those skilled in the art will understand that a motor may be substituted for or used in its place to operate a gear crank of which the lever arms 106 may form a part and be operated thereby. When the lever arm 106 is rotated by the operating solenoid or motor 112, the plate 96 is moved in an arcuate path from its position as shown in Fig. 9 to that of Figs. 10 and 11. This arcuate movement is in the direction away from the passageway P of the station V toward the downstream or exit of the storage station S to move the sheet of paper currency longitudinally away from and out of the path of the next or successively fed sheet of currency C that is in the passageway P.

As seen in Figs. 12 and 13, the system is provided with a conventional computer logic system or computer processing unit (CPU) capable of responding to the sensed criteria and signals to actuate via a plurality of ganged trigger circuits for proper movement and operation of the mechanical elements described.

Operation of the paper currency acceptor 10 can be followed from the diagrams, although a brief description in combination with FIGS. 3–11 may be helpful. The CPU is preferably a conventional commonly available 8751 microchip. The trigger circuits are also commercially available units. The lamps **72*a* and 75*a* providing the light sources for sensors 72 and 75 at the inlet 32 to the passageway P and at the end thereof respectively are provided with power so that they are normally lit. Upon insertion of the sheet of paper currency C through the aforementioned currency slot 18 in the door 12 of the vending machine, the paper currency C passes into the funnel-shaped entrance 32** and moved around the curved portion of the linear passageway P.

Upon doing so, the forward edge of the paper currency passes the previously described apertures or holes 74 in the troughs 22 and 24 thus interdicting the light from source 72*a* incident upon the photocell 72. The photocell 72 produces a signal which is passed to the CPU that conducts a continuous power signal through inputs 118 and 119 of the reversible motor 70 to operate the motor in the forward direction and to actuate the endless conveyor belt 60 to move the paper currency C longitudinally further into the passageway P. Simultaneously, the magnetic sensing heads 76 evaluate the authenticity and value of each sheet of paper currency C as it is transported through the passageway P, until the entire length of the sheet of paper currency passes the magnetic sensing heads 76.

The leading end of the sheet of the paper currency C is detected by the sensor device 75 located at the end of the passageway P. On sensing the leading end of the sheet of paper currency C the motor 70 is stopped by providing a signal to inputs 119 and 120 respectively arresting the movement of the conveyor 60. In addition, the CPU may activate a timer preset to the maximum time needed for a paper currency C to pass from the photocell 72 to the stop sensor 75, so that in the event a paper currency jams in the passageway P, or even a short or incomplete sheet of paper currency is inserted, the timer will stop the conveyor 60.

Considerable advantage arises from employing paired photosensors 72 and paired magnetic read-out devices 76 to prevent, in the first instance, the fraudulent technique of inserting part of a bill, and in a second instance, the need to insert the paper currency either heads-up or heads-down. The photocell 72 at the inlet funnel 32 is arranged in cooperation with the downstream sensor 75 so that the length of the paper currency is detected. This acts to also prevent counterfeit or part currencies, etc. from passing through the system. During the movement of the paper currency C, the magnetic sensing head 76 ensures that an entire paper currency has passed by it and that the whole of the paper currency is authentic.

If the paper currency is deemed acceptable, the magnetic sensing head 76 issues a signal transferred by the CPU to the reversible motor 70 to continue feeding movement of the paper currency by the conveyor 60 in the direction and its storage position in the station S. Conversely, if the paper currency C is not acceptable, the magnetic sensing heads 76 issue a signal by which the CPU causes the motor 70 to reverse its direction so that the upper run of the belt 60 reverses its direction and moves backwardly carrying the paper currency in the reverse direction ejecting the paper currency from the inlet 32 and slot 18. This rejection signal may also be initiated by the timer in the event an improper length paper currency or gram occurs. In this manner, automatic rejection of the paper currency takes place before the sheet of paper currency even reaches the storage station S.

On acceptance of the paper currency by the magnetic sensing head 76, the continuous conveyor belt 60 is caused to operate to move in the direction of the storage station S carrying with it the sheet of paper currency C which moves through and out of the passageway P and smoothly into the guide path formed by the ledges 88 and 89 to the storage position. When the paper currency C moves to the storage position in the guide path, it is positioned aligned with the platform 92 and the presser plate 96. The platform 92 is constantly biased into its raised active position so that it is ready to engage the planar surface of the facing paper currency C. It is desirable to leave the paper currency C in its storage position in the guide path between the ledges 88 and 89 until subsequent or successive sheet of paper currency is fed to the verification station.

When the sheet of paper currency C reaches the storage position, the solenoid 112 is thereafter activated, causing the presser plate 98 to press against and push the sheet of paper currency C out of the guide path 90, beyond te ledges 88 and onto the platform 92. On release of the solenoid 112, the platform 92, being normally biased upwardly rises with the return of presser plate 96 to its inactive position. As seen in FIG. 11, the upward rise of the platform 92 causes the stack of bills C to engage along their longitudinal side edges 116 on the undersurface of the ledges 88 and to be held firmly between the raised platform 92 and the retainer undersurfaces of the ledges 88. Subsequent fed sheets of currency C are stacked one upon the other and no matter how high the stacking is, the stack is held firmly between the platform 92 and the retainer ledges 88.

Removal of the bills accumulated in the storage chamber 86 is extremely simple, since the downstream end of the chamber 86 is open and provided with an enlarged U-shaped cut-out 20 defined in the base of the housing 58. This open end enables free and easy access, by the serviceman into the interior of the chamber 86 for withdrawal of the bundled stack of accumulated bills.

Further, the CPU is provided with a Schmidt trigger circuit 122 actuable on receipt of a signal from both the magnetic sensor 76 (FIG. 12), converting the read signal to a corresponding coin value and combination of coins equivalent thereto. This coin value and combination is thereafter transmitted directly to the coin counting mechanism 124 and the coin vending device 126 of the mechanism 16 to indicate whether the full amount of money has been received for the product to be dispensed. If more than the full amount of money is received, the coin mechanism 16 will be operated to dispense the predetermined amount of coin change to be returned to the buyer at the mechanism 16. If an inadequate amount of money is received, the paper currency in the verification and storage stations will be returned to the slot 18.

It will be clear that for the first time the present invention provides a paper currency acceptor 10 that is capable of being mounted to the rear advertising panel portion of a vending machine door 12 in a horizontal position to receive the sheets of paper currency with their planar surfaces in a substantially vertical position and to convey and move the same from the substantially vertical inlet in such vertical position to a storage position where they are stored and stacked so that their planar surfaces are substantially vertical and substantially parallel to the back of the panel portion. The substantially vertical position and size of the inlet slot 18 is such that it does not deface or interfere with the advertising function of the panel portion 17.

By mounting the acceptor 10 substantially flat against the back of the door 12 and the panel 17 the sheets of currency C are moved in their substantially vertical planar position longitudinally in the direction of their length. The movement is in a straight line behind the door panel portion 17 and in a substantially horizontal path that requires a minimum amount of space since the available space behind the panel portion is extremely small and limited. The acceptor 10 takes advantage of such limitations. It is also capable of being closely located adjacent the existing coin mechanisms 16 without requiring any change in them, yet enabling the acceptor 10 to be integrated with the operation of the coin mechanism to enable the acceptance of paper money in excess of the capacity of the coin mechanism and to enable the coin mechanism to provide change, when required.

The foregoing disclosure sets forth several forms and embodiments. Changes, additional embodiments, and modifications will also be apparent to those skilled in this art. The disclosure, therefore, is to be taken as illustrative and not limiting of the invention.

What is claimed is:

1. In a paper currency acceptor for vending machines and the like comprising a housing having inlet for the receipt of a sequency of paper currency bills fed individually thereto, means for sensing the insertion of each bill fed to said inlet a verification station and a storage station axially arranged at the end thereof, said verification station having a passageway defined by a pair of relatively spaced planar members between which successive bills may be longitudinally moved and restrained, said passageway having one end aligned with said inlet and its other end aligned with said storage station and having means adjacent each end for determining that the bill inserted therein is of the proper length and for rejecting through said inlet, faulty bills, and conveyor means located within said verification station responsive to the means for sensing the insertion of the successive bill into said inlet for automatically indexing the retained stepwise through said passageway and verification station and subsequently longitudinally ejecting said bills successively to said storage station, said storage station comprising a pair of spaced parallel guide rails defining on one surface a guide path coaxially extending from and co-planarly aligned with said passageway for slideably receiving and supporting said bills along the edges of said bills parallel to the direction of movement as said bills are successively indexed from said verification station, and a moveable platform lying in a plane parallel to and offset from said guide path spanning the paired guide rails opposite said guide path and spring means resiliently biasing said platform to normally press against said guide rails on the surface opposite said guide path, and displacement means offset from said guide path and in alignment with the space between the guide rails, said displacement means being operable, on movement of a bill into alignment therewith and in response to the introduction of the succeeding bill into said inlet to reciprocably extend into and retract from said space between said guide rails to translate said aligned bill from said guide path onto said platform such that said guide path is left vacant to receive a succeedingly indexed bill said platform cooperating with said displacement means to permit the edge of successively translated bills to fall between said guide rails and said platform on extension of said displacement means to create a bundle of bills stacked one on top of the other said stack being resiliently compressed between said platform and the opposite surface of said rails, on retraction of said displacement means, including detecting means operable at said verification station for determining the authenticity and value of the paper currency indexed thereto, said conveyor means being operable in response to a determination that each bill of said paper currency is authentic to permit the bill to be subsequently indexed along said passageway and guide path to said storage position on the insertion of another bill, and in response to a determination that the bill is not authentic to operate said conveyor means prior to the insertion of any subsequent bill to move the bill in an opposite direction to return and reject it through said inlet.

2. The acceptor according to claim 1, wherein said retention container is open at a lateral end thereof, permitting access therein for removal of the said bills in the stacked bundle condition.

3. The paper currency acceptor according to claim 1 wherein said passageway is defined by relatively spaced plate-like members, at least one of said plate-like member having an elongated opening extending longitudinally therein, said conveyor means including at least a continuous conveyor belt mounted within said elongated opening having a longitudinal extent within said passageway for moving the paper currency, and reversible motor means operable selectively by said verifying means and connected with and for selectively driving said belt in opposing directions.

4. The paper currency acceptor according to claim 3 wherein the means for verifying the authenticity and value of said currency is mounted on one of said plate-like members in communication with said passageway.

5. The paper currency acceptor according to claim 1 wherein said means for detecting the length of said bill comprises means for sensing the presence of paper currency at the exit from verification station, acting in cooperation with said sensing means at said inlet to authenticate the full length of the paper currency being inserted and to return any reject through said inlet.

6. The paper currency acceptor according to claim 1 wherein said housing comprising an elongated rectilinear channel container having a pair of opposed side walls interconnected by a mounting wall and an open wall opposite said mounting wall, said verification and storage stations are mounted within said container with their respective passageway and guide path in co-planar alignment and in a horizontal direction so that the direction of movement of the paper currency is in a straight horizontal line and the sheet surfaces of the bills are moved in a direction and stored substantially parallel to said mounting surface.

7. The paper currency acceptor according to claim 6 wherein said vending machine has a door to provide access to the interior thereof, said door having a product illustration panel thereon for display of the products of said machine, said mounting surface is a rear of the product illustration panel of the door of a vending machine, and said passageway and guide path direct the movement of the paper currency with its planar surfaces substantially vertical, and said retention means retaining the planar surfaces of the paper currency substantially vertical in said storage position and substantially parallel to the rear of said door panel.

* * * * *

UNITED STATES PATENT AND TRADEMARK OFFICE

CERTIFICATE OF CORRECTION

PATENT NO. : 4,884,671

DATED : December 5, 1989

INVENTOR(S) : VEDASTO GARDELLINI

It is certified that error appears in the above-identified patent and that said Letters Patent is hereby corrected as shown below:

Column 11, line 24 after "having" insert --an--
Column 11, line 25 "sequency" should be --sequence"
line 40 after "retained" insert --bill--

Signed and Sealed this

Eleventh Day of September, 1990

*Attest:*

HARRY F. MANBECK, JR.

*Attesting Officer*

*Commissioner of Patents and Trademarks*